United States Patent [19]

Hazelton et al.

[11] Patent Number: 4,874,447

[45] Date of Patent: Oct. 17, 1989

[54] MELT BLOWN NONWOVEN WEB FROM FIBER COMPRISING AN ELASTOMER

[75] Inventors: Donald R. Hazelton, Chatham, N.J.; William J. Hodgson, Jr., Baytown, Tex.

[73] Assignee: Exxon Chemical Patents, Inc., Linden, N.J.

[21] Appl. No.: 272,581

[22] Filed: Nov. 17, 1988

Related U.S. Application Data

[62] Division of Ser. No. 6,867, Jan. 27, 1987, Pat. No. 4,804,577.

[51] Int. Cl.[4] ..... D04H 3/16

[52] U.S. Cl. ..... 156/167; 264/555; 264/518; 156/244.24

[58] Field of Search ..... 156/167, 244.24; 264/555, 518

[56] References Cited

U.S. PATENT DOCUMENTS

| | | | |
|---|---|---|---|
| 2,939,860 | 6/1960 | Schramm | 525/232 |
| 3,018,263 | 1/1962 | Schneider | 525/232 |
| 3,262,997 | 7/1966 | Edwards et al. | 525/232 |
| 3,276,944 | 10/1966 | Levy | 161/150 |
| 3,917,501 | 11/1975 | Ferrucci et al. | 525/232 |
| 4,130,534 | 12/1978 | Coran | 260/33.6 AQ |
| 4,663,220 | 5/1987 | Wisneski et al. | 428/224 |

*Primary Examiner*—Carman J. Seccuro
*Attorney, Agent, or Firm*—J. F. Hunt

[57] ABSTRACT

A nonwoven web is prepared from a polymeric blend comprising at least one elastomer and at least one thermoplastic resin. The nonwoven web comprises fibers produced by melt blowing the polymeric blend. Conventional techniques are used to accomplish the melt blowing but due to high viscosity of certain elastomers it is frequently necessary to degrade the polymer blend priior to melt blowing. The nonwoven web exhibits improved extensibility, texture and hand.

14 Claims, No Drawings

MELT BLOWN NONWOVEN WEB FROM FIBER COMPRISING AN ELASTOMER

This is a division of application Ser. No. 006,867, filed Jan. 27, 1987, now U.S. Pat. No. 4,804,577.

BACKGROUND OF THE INVENTION

This invention relates to a novel fiber, to a nonwoven mat comprising said novel fiber, and to a method of preparing said web. More particularly, this invention relates to a fiber which is prepared from a polymeric blend comprising at least one elastomeric polymer and at least one thermoplastic polymer, to a nonwoven web comprising said fiber and to a method for preparing said melt blown web.

Nonwoven webs containing various polymeric fibers are, of course, well-known in the prior art. Processes for preparing nonwoven mats from thermoplastic fibers have been described in such publications as Naval Research Laboratory Report No. 111437 which was submitted Apr. 15, 1954; NRL Report 5265, which is dated Feb. 11, 1959 and in an article appearing in Industrial and Engineering Chemistry, Vol. 48, No. 8 (1956), pages 1,342–1,346. Such processes are also described in U.S. Pat. Nos. 2,374,540; 2,411,659; 2,411,660; 2,437,363 and 3,532,800. Still other methods for preparing the same or similar nonwoven webs are described in British Patent Nos. 1,055,187 and 1,215,537 and in U.S. Pat. Nos. 3,379,811 and 3,502,763. A method for preparing nonwoven webs from elastomeric fibers by spray spinning a rubber solution is described in U.S. Pat. No. 2,950,752.

As is well known, several of the nonwoven mats heretofore proposed have found utility in a broad range of applications. For example, it is known to use nonwoven mats, particularly those obtained with thermoplastic fibers, in the preparation of battery separators, cable wrap, capacitor paper, as wrapping materials, clothing liners, diaper liners, in the manufacture of bandages and sanitary napkins and the like. Notwithstanding this success, however, the nonwoven mats prepared from thermoplastic fibers do not generally exhibit the delicate balance of properties that would be most desirable in many of these applications. In this regard, it should be noted that the nonwoven mats prepared with thermoplastic fibers are, generally, relatively rigid and firm. These nonwoven mats are, however, generally, nonextensible and do not exhibit any significant softness or hand. Conversely, nonwoven mats prepared with elastomeric fibers are, generally, soft, elastic and resilient. These mats, however, have little if any strength or rigidity. It is, of course, known in the prior art that these deficiencies can, at least, be reduced by laminating the nonwoven mats with other materials, which other materials may be either woven or nonwoven themselves. Even these laminates do not, however, exhibit the delicate balance of extensibility, softness, texture, hand and drape that is desirable for many of the known applications wherein nonwoven mats are used. Moreover, this lack of property balance has limited the areas in which nonwoven mats may be used. The need, then, for an improved nonwoven mat and for a fiber to prepare such a mat is believed readily apparent.

SUMMARY OF THE INVENTION

It has now been discovered that the foregoing and other disadvantages of the prior art nonwoven webs can be avoided or at least reduced with the nonwoven webs of the present invention. It is, therefore, an object of this invention to provide an improved nonwoven web. It is another object of this invention to provide a polymeric fiber for preparing such nonwoven webs. It is still another object of this invention to provide such an improved nonwoven web that is, generally, softer, more elastic and which exhibits good drape properties. The foregoing and other objects and advantages will become apparent from the description set forth hereinafter.

In accordance with the present invention, the foregoing and other objects and advantages are accomplished by preparing a nonwoven web from a polymeric fiber blend comprising at least one elastomeric polymer and at least one thermoplastic polymer. The nonwoven web may be prepared using any of the methods known in the prior art. Since melt rheology is critical to most processes used heretofore, however, specialized compounding techniques will be used in the present invention to facilitate incorporation and dispersion of the highly viscous elastomer into the less viscous thermoplastic resin. Particularly, premixed blends of the elastomeric polymer and the thermoplastic resin which have high viscosities will be subjected to controlled degradation, preferably in the presence of a free radical source compound, until the intrinsic viscosity of the blend is reduced to a value within the range suitable for the preparation of a nonwoven web. As also indicated more fully hereinafter, preferred nonwoven webs are obtained when the distance between the fiber preparation means and the web collecting device is controlled within a relatively narrow range.

DETAILED DESCRIPTION OF THE INVENTION

As indicated supra, this invention relates to a nonwoven web, to a polymeric fiber used in preparing said web, which polymeric fiber is prepared from a polymeric blend comprising at least one elastomeric polymer and at least one thermoplastic polymer and to a process for preparing said nonwoven web. As also indicated supra, it is important to the present invention to carefully control the rheology of the premixed blends of elastomers and thermoplastic resins without impairing the blend's fiber forming characteristics to facilitate the preparation of a fiber from the premixed blend.

In general, any elastomer known in the prior art which can be thermally or oxidatively degraded to reduce its viscosity may be used in the preparation of the fiber of this invention, blended with a thermoplastic resin and used to produce the nonwoven mat of this invention. Suitable elastomers include copolymers of an isoolefin and a conjugated polyolefin. In general, such copolymers will comprise not more than 30 wt % of said conjugated polyolefin and will preferably contain from about 85 to about 99 5 wt % of said isoolefin and 0.5 to 5 wt % of said polyolefin. Copolymers of isobutylene and isoprene falling within this range and known as Butyl rubber are particularly useful as elastomers in this invention. Halogenated derivatives of these isoolefin-polyolefin copolymers are also particularly useful as elastomers in this invention. Suitable elastomers also include polyolefin rubbers such as polyisobutylene, and the ethylene-$\alpha$-olefin rubbers wherein said $\alpha$-olefin has from 3 to 18 carbon atoms such as ethylene-propylene rubber, and ethylene-butylene rubber, particularly those containing less than about 50 wt % ethylene, and the ethylene-α-olefin-diolefin rubbers such as ethylene-propylene-hexadiene rubber and the like. Suitable elastomers also include lower molecular weight polymers prepared from these same monomers and elastomers prepared by polymerizing one or more diolefins either alone or with one or more alkenyl aromatic hydrocarbons, particularly polybutadiene, butadiene-styrene elastomers and isoprene-styrene elastomers. In general, elastomers useful in the preparation of the fiber of this invention will have a starting weight average molecular weight within the range from about 60,000 to about 2,000,000 and a number average molecular weight within the range from about 30,000 to about 1,000,000.

In general, any of the thermoplastic resins known in the prior art to be useful in the preparation of nonwoven webs may be used in the fiber of this invention and the nonwoven web prepared with this fiber. Suitable thermoplastic polymeric resins for use in the preparation of the fiber of this invention include polymers of branched and straightchained olefins such as polyethylene, polypropylene, polybutylene, polypentene, polymethylpentene and the like and various copolymers of ethylene and propylene. Copolymers of ethylene suitable for use in the present invention include copolymers of ethylene with unsaturated esters of lower carboxylic acids as well as the carboxylic acids per se. In particular copolymers of ethylene with vinylacetate or alkyl acrylates, for example, methyl acrylate and ethyl acrylate. These ethylene copolymers typically comprise about 60 to about 97 wt % ethylene preferably about 70 to about 95 wt % ethylene, more preferably about 75 to about 90 wt % ethylene. Copolymers of propylene include copolymers of propylene and ethylene and propylene and an α-olefin containing 4 to 16 carbon atoms. Suitable polypropylene and propylene copolymers may be highly crystalline isotactic or syndiotactic. The density of these polymers may be from about 0.8 to about 0.95 g/cc.

In general, any of the methods known in the prior art for blending polymeric materials may be used to blend the elastomeric polymers and the thermoplastic polymeric resins useful in the present invention. For example, pellets of each of the materials to be premixed could, simply, be physically admixed using suitable solid mixing equipment and the solid mixture then passed to the extruder portion of a melt blowing apparatus. Better results will, however, frequently be achieved when the resins are first physically admixed as solids and then melt blended together. In this two-stage blending scheme any suitable dry mixing equipment could be used and then any suitable melt blending equipment used. Melt blending also facilitates feeding of the blend to the melt blowing equipment.

In general, the fibers of this invention will comprise from about 5 to about 75 wt % elastomeric polymer and from about 95 to about 25 wt % thermoplastic polymeric resin. Blends containing higher amounts of elastomeric polymer may, however, be prepared and then combined with additional thermoplastic polymeric resin downstream from the initial blending operation. In fact, and as indicated more fully hereinafter, it has surprisingly been learned that blends having elastomeric polymer contents within the higher portions of the useful range heretofore mentioned are most readily melt blown when blends containing thermoplastic polymer concentrations within the range from about 50 to about 85 wt %, with the remainder being thermoplastic polymer resin, are prepared, degraded either thermally or in the presence of a free radical source compound and then further blended with additional thermoplastic polymer resin to produce the blend subsequently fed to a melt blowing apparatus.

While any of the methods known in the prior art may be used to prepare the nonwoven web of this invention, the web is most readily prepared in those processes wherein the polymer blend is melted and passed through a plurality of dies such as the melt blowing processes. The invention will, therefore, be described by reference to the use of a melt blowing process to prepare the web. In this case, then, the blends of elastomeric polymer and thermoplastic polymer resin useful in the present invention will be melt blown in an apparatus such as that disclosed in U.S. Pat. Nos. 3,755,527; 3,841,953; 3,849,241; 3,978,185 and 4,048,364, the disclosure of which patents are herein incorporated by references. As is well known in the prior art, and when using apparatus of this type, it is important that the polymer or polymer blend have an apparent viscosity in the nozzle orifices of from about 50 to about 500 poise. As is also believed well known in the prior art, elastomeric polymers frequently exhibit viscosity well above 500 poise at melt blowing conditions and this is true even when the elastomeric polymer is blended with a lower viscosity thermoplastic polymer resin. Moreover, and as is well known in the prior art, certain of the thermoplastic polymer resins useful in the present invention also exhibit viscosity above 500 poise at melt blowing conditions. As a result, blends useful in the present invention must be treated to reduce their viscosity to a value within the range suitable for melt blowing.

It is, of course, known in the prior art to degrade thermoplastic polymer resins to reduce their viscosity prior to melt blowing. Such degradation is taught in U.S. Pat. Nos. 3,849,241 and 3,978,185, the disclosure of which patents are herein incorporated by reference. The technique taught in these patents is, of course, equally useful for degradation of the blends of elastomeric polymer and thermoplastic polymer resins useful in the present invention. The technique is also useful for the degradation of blends containing even higher concentrations of elastomeric polymer, to which blends additional thermoplastic polymer resin having a suitable rheology will be added prior to melt blowing in accordance with the method of the present invention. In general, blends comprising more than about 10 wt % elastomeric polymer will exhibit viscosity above 500 poise at melt blowing conditions and will, therefore, be subjected to degradation prior to melt blowing. The actual amount of elastomer that may be tolerated in the blend without subjecting the blend to degradation will, however, vary with both the particular elastomer or elastomers and the particular thermoplastic resin or thermoplastic resins used in the blend. Similarly, the actual viscosity of any given blend will vary somewhat with the particular elastomeric polymer or polymers and the particular thermoplastic polymeric resin or resins actually contained in the blend. Determination of viscosity at melt blowing conditions and the need for degradation of the blend prior to melt blowing is, of course, well within the ordinary skill of the art.

As indicated in U.S. Pat. Nos. 3,849,241 and 3,978,185, there are at least a few general approaches to bring about the extent of degradation requisite to making the polymer blend suitable for practicing the present invention. Temperatures well above the melting point of the polymer can be employed in the absence of free radical source compounds to promote thermal and oxidative degradation. When this approach is used, the polymer blend may be subjected to a temperature within the range from about 550° F. to about 900° F., preferably within the range from about 600° F. to about 750° F. for a period of time effective to cause the requisite extent of degradation, typically from about 1 to about 10 minutes, preferably from about 2 to about 6 minutes. At these temperatures, and when oxygen is present, both thermal and oxidative degradation occur. As indicated in both of the foregoing patents, oxidative degradation is predominate at lower temperatures within the aforementioned range and thermal degration is predominate in the higher temperatures within said range. Oxidative degradation is, however, most preferred in the present invention and such degradation may be accomplished at even lower temperatures when oxidative degradation is promoted by the presence of one or more free radical source compounds. The use of such compound when degradation is either necessary or desirable is, therefore, preferred in the present invention.

Suitable free radical source compounds include organic peroxides, thiyl compounds (including thiazoles and thiurams, thiobisphenols and thiophosphites) and organo-tin compounds. Preferred free radical source compounds include t-butylbenzoate, dicumylperoxide, 2,5-dimethyl-2,5-di-t-butyl-peroxy-3-hexene (Lupersol 130), $\alpha,\alpha'$-bis(t-butylperoxy) diisopropyl benzene (Vul Cup R), or any other free radical source compounds having a ten hour half-life temperature over 80° C., or mixtures thereof. In general, the higher the decomposition temperature of the free radical source compound, the better. Reference is made to pp 66–67 of *Modern Plastics,* November, 1971, for a more complete list of suitable free radical source compounds. Sulfur compounds which give rise to suitable thiyl compounds are disclosed in U.S. Pat. No. 3,143,584. Suitably, such free radical source compounds are used at concentrations in the range from about 0.01 to about 5 wt %, preferably from about 0.1 to about 3 wt %.

Once a blend of elastomeric polymer and thermoplastic polymer resin having an apparent viscosity within the range suitable for melt blowing is prepared, the blend will be passed to a melt blowing apparatus. Blends comprising elastomeric polymer concentrations within the lower part of said viscosity range, generally blends containing less than about 10 wt % elastomeric polymer, may be fed directly to the melt blowing apparatus. Blends containing more than about 10 wt % elastomeric polymer, however, will be degraded either thermally or oxidatively, or both, prior to feeding to the melt blowing apparatus. Moreover, blends comprising more than about 50 wt % elastomeric polymer may first be thermally or oxidatively degraded and then blended with additional thermoplastic polymer resin of a suitable viscosity prior to feeding to the melt blowing apparatus. Moreover, and particularly when the blend comprises a free radical source compound, the degradation may be accomplished at least in part while the blend is in the feed extruder to the melt blowing apparatus and in the die head.

In any case, and when a suitable feed blend is available, the blend will be fed to a feed extruder of a melt blowing apparatus. A suitable feed blend is, of course, any blend which will have an acceptable viscosity when it reaches the melt blowing nozzles and includes blends which will degrade sufficiently in the extruder and die head. As indicated supra, degradation in the feed extruder and die head may be facilitated by the presence of one or more free radical source compounds.

In general, feed blends will be subjected to temperatures in the range of 300° F. to 900 F., preferably to temperatures within the range from about 300° F. to about 550° F. while in the extruder. The actual temperature employed depends, primarily, upon the amount of heat treatment necessary to render the blend suitable for melt blowing operations.

As is well known in the prior art, the extruder will be driven by a suitable driving means. At the outlet of the extruder, the feed blend is forced into a die head. The die head may contain a heating plate which may also be used to impart any further thermal treatment required to render the blend suitable for melt blowing. From the die head, the feed blend is forced through a row of die openings and into a gas stream or streams which attenuates the blend into fibers which are collected on a moving collection device such as a rotating drum to form a continuous nonwoven mat. The gas stream or streams which attenuates the feed blend may be supplied through one or more gas jets, preferably at Ieast two with one above and one below the stream of fibers. In general, the gas jets supply a hot gas, preferably air, generally at a temperature within the range from about 500° F. to about 900° F.

As is also well known, the die portion of the melt blowing apparatus and particularly the cross-sectional flow area of the nozzle and the number of nozzles per unit length across the die head are important variables in melt blowing operations. In general, suitable fibers, and hence, suitable nonwoven mats may be prepared with blends within the scope of the present invention using nozzles having cross-sectional flow areas within the range from about $3\times10^{-6}$ in$^2$ to about $7.5\times10^{-4}$ in$^2$ and when there are from about 15 to about 40 nozzles per linear inch of die head.

As is known, gas flow rate will significantly impact upon the fiber size. In this regard, it should be noted that gas flow rates within the range from about 2.5 to about 20 lb/min/in$^2$ of gas outlet area generally produced macro-denier fibers; i.e., fibers having a diameter within the range from about 8 to about 50 microns, while higher gasflow rates within the range from about 20 to about 100 lbs/ min/in$^2$ of gas outlet area produced micro-denier fibers; i.e., fibers having a diameter within the range from about 0.5 to about 5 microns. The actual diameter of the fiber, however, also depends a great deal upon the flow rate of polymer or polymer blend through the nozzle, and the apparent viscosity of the polymer or polymer blend at the die. As a result, polymers or polymer blends having an apparent viscosity in the higher portion of said viscosity range will not produce micro-denier fibers even at the higher gas flow velocities within the aforementioned higher range. These criterion do, of course, hold true in the present case and, hence, it is not generally possible to produce microdenier fibers with all of the blends contemplated for use in the present invention. This is particularly true with blends comprising elastomeric olefin copolymers such as ethylenepropylene and ethylene-propylene-diolefin. Notwithstanding this, however, and as indicated more fully hereinafter, certain of the high viscosity blends within the scope of the present invention produced interesting fibers and nonwoven mats having a wide range of utility and offer improved properties for these applications.

In general, the nonwoven mats of this invention may be collected at a distance within the range from about 7 inches to about 27 inches. In general, the nonwoven mats produced when the fibers are collected at a relatively short distance will be more compact than those collected at a greater distance. Moreover, those collected at a shorter distance will, generally, have a higher tensile strength and lower tear resistance than those collected at a greater distance from the nozzle. The distance at which the nonwoven mat is collected does, then, afford a variable which may be used to vary such properties as drape, elasticity, resilience, appearance, and the like. In general, optimum properties will be realized in producing mats within the scope of the present invention when the mat is collected at a distance within the range from about 12 inches to about 18 inches from the nozzle.

As is known in the prior art, the temperature of the moving collection device frequently runs well above room temperature due to the temperature of the fibers leaving the dies. While this has not, heretofore, posed any problems with respect to the formation of nonwoven webs with nonelastic thermoplastic polymers, several methods have been proposed for cooling the rotating drum commonly used. Due to the relatively low melting point of the elastomers used in the nonwoven mats of this invention, however, the elevated temperatures frequently cause the webs to be tacky and difficult to remove from the rotating drum. This operating difficulty can be easily corrected by partially submerging the drum in a water bath. Care should be taken, however, to maintain the water level below the level of the mat on the drum. To further facilitate the separation, additives such as antistatic agents and slip-aiding agents, which would enable separation, may be added to the water bath.

In general, shot, which is defined as an unattenuated fiber or solid sphere of polymer, tends to increase in the method of the present invention with increasing elastomer content in the fiber or web. This is, apparently, due to the tendency of high viscosity elastomer fibers to break abruptly upon exit from the die. When the elastomer content is, however, maintained within the aforementioned viscosity limit the amount of shot produced is acceptable in the nonwoven mat product. Further, when the amount of elastomer contained in the blend is in the lower portion of the aforementioned operable range as well as when the blend is degraded so as to significantly reduce viscosity, the amount of shot produced is significantly reduced. Moreover, it has been found in practicing the present invention that the amount of shot produced is reduced at higher air velocities. This is, of course, contra to the result obtained when thermoplastic resins are melt blown.

The nonwoven mats of this invention may, of course, be calendered using techniques well known in the prior art. Generally, calendering the nonwoven mats of this invention will improve the drape, elasticity and feel (texture) properties of the nonwoven mat. In general, the calendering will be accomplished at a temperature within the range from about ambient temperature to about 250° F. at a pressure within the range from about 25 psig to about 100 psig, depending primarily upon the melting temperature of the elastomer.

In general, the extruder used in the present invention will contain a heater as will the die head. As is known, it is necessary to at least heat the polymer blend to a temperature above its melt point. Moreover, when the polymer is to be degraded in the extruder, either in the presence or absence of a free radical source compound, temperatures well above the melt point and, generally, within the range from about 300° F. to about 900° F. will be used. The actual temperature used for any given blend will of course, vary. In general, however, if the temperature is too low the nonwoven mat product will contain large globs of polymer and/or coarse ropy material. As the temperature in the extruder is increased, the nonwoven mat will become softer and contain less shot. When the temperature in the extruder and/or die head is too high, on the other hand, the nonwoven mat will become extremely soft and fluffy and the air flow will, generally, cause extreme fiber breakage and short fibers will be blown away from the laydown zone. As a result, the melt blowing operation is, generally, watched continuously and the temperature adjusted as required. In general, the optimum temperature for any particular blend will also permit the maximum polymer flow rate at a minimum die pressure.

In general, the polymer blends of the present invention may be fed through the dies at a rate within the range from about 0.1 to about 1.0 grams per minute per die opening. In general, the flow rate for any given polymeric blend will be controlled by the speed of the feed extruder but the flow rate will also vary with the temperature at the die head.

In general, the nonwoven mats of this invention, due primarily to the elastomer content thereof, will exhibit resilience, improved texture and drape and a softer hand than nonwoven mats prepared with thermoplastic resins. Moreover, due to the thermoplastic resin content, the nonwoven mats of this invention will exhibit improved extensibility and tear resistance. Further, the macro-denier fiber nonwoven mats of this invention will have a more open structure and hence an increase void volume in the nonwoven mat.

In general the nonwoven webs of this invention may be used in any of the applications known in the prior art for such nonwoven webs. Due to the relatively low melting point of the elastomeric component of the present invention, however, the nonwoven webs of this invention may also be used in areas where adhesive webs that breathe are desirable. The nonwoven webs of this invention may then be used in the manufacture of shoes, protective clothing, tarpaulins and tents.

PREFERRED EMBODIMENT OF THE PRESENT INVENTION

In a preferred embodiment of the present invention, a low molecular weight elastomer; i.e., an elastomer having a low enough viscosity at die head conditions to permit its use with minimal degradation, will be combined with a thermoplastic resin also having a viscosity at die head conditions sufficiently low to permit its use without degradation. Polyisobutylene and isobutylene-isoprene copolymer rubbers are particularly preferred elastomers for use in the present invention. Low molecular weight (high melt flow rate) polypropylene and (high melt-index) ethylene-vinyl acetate copolymers are particularly preferred thermoplastic resins useful in the present invention.

In a preferred embodiment of the present invention, the blend will comprise from about 10 to about 65 wt % elastomer and from about 90 to about 35 wt % thermoplastic resin. In a most preferred embodiment of the present invention, the blend will comprise from about 15 to about 50 wt % elastomer and from about 85 to about 50 wt % thermoplastic resin. In both the preferred and most preferred embodiments, the blend will first be dry blended and then melt blended prior to feeding the same to the melt blowing apparatus feed extruder. Both the extruder and the die head will be operated at a temperature within the range from about 300° F. to about 550° F. The nonwoven mat will be collected at a distance within the range from about 12 to about 18 inches from the die head.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example, a masterbatch blend comprising 50 wt % of an isobutylene-isoprene copolymer having a weight average molecular weight of about 350,000 and 50 wt % of a polypropylene having a melt flow rate of 1.3(230° C.) was prepared. The blending of the masterbatch was accomplished by melt blending in a Banbury mixer to insure good mixing. The masterbatch blend was then dusted with 0.15 wt % of Lupersol 130 peroxide in a Henschel blender and then broken down in molecular weight at a temperature within the range from about 410° F. to about 430° F. in a single screw extruder. A portion of the free radical degraded masterbatch blend was then combined with additional polypropylene having a melt flow rate of 32(230° C.) (higher than that used in the masterbatch) on a 25/75 vol % basis to yield a blend containing approximately 12.5 wt % elastomer. The fiber blend, containing 25 vol % of the free radical degraded polymer blend and 75% additional polypropylene, was then fed to a melt blowing apparatus having a die head 20 inches wide and containing 401 horizontal dies each having a diameter of 0.38 mm. The melt blowing apparatus provided two streams of heated air, one above and one below the dies, to attenuate the molten filaments and at 100% flow rate the air velocity approached sonic velocity. The apparatus also comprised a rotating screen drum for collecting the fibers and in this run the drum was positioned 12 inches from the dies and rotated at 14 ft/min. In this run, the air flow rate was 65% of maximum and the extruder and die head was operated at a temperature of approximately 520° F. The air temperature in the upper stream at the die head was 523° F and the temperature of the bottom stream at the die head was 531° F. The resin flow rate through the dies was about 13 lb/hr during this run. The nonwoven web produced contained micro-denier fibers, was elastic, soft and uniform in texture. This particular nonwoven web was also more opaque than webs that were prepared with different elastomers, particularly ethylene-propylene copolymers.

EXAMPLE 2

In this example, a nonwoven web was prepared using a fiber blend identical to that used in Example 1 and the melt blowing apparatus was operated at the same conditions except that the air-flow rate was increased from 65% of maximum to 85% of maximum. The nonwoven web produced, then, contained micro-denier fibers somewhat smaller than the fibers produced in Example 1. The nonwoven web produced in this example was significantly softer and smoother than the web produced in Example 1. The web thus produced had a basic weight of 0.9 oz/yd$^2$; a tenacity of 0.131 g/denier in the machine direction and 0.085 g/denier in the transverse direction; an elongation of 41% in the machine direction and 77% in the transverse direction and a tear strength of 24 g in the machine direction and 34 g in the transverse direction.

EXAMPLE 3

In this example, a nonwoven web was produced with a fiber prepared from a polymer blend comprising 50 vol % of the free radical degraded polymer blend produced in Example 1 and 50 vol% of a polypropylene identical to that added in Examples 1 and 2. The blend used in preparing this nonwoven web contained approximately 25% elastomer. The melt blowing apparatus was operated at substantially the same conditions as were employed in Example 2. The nonwoven web produced contained micro denier fibers, was very uniform in texture and very soft. This nonwoven web, too, was more opaque than webs prepared from blends containing an ethylene-propylene copolymer. The web thus produced had a basic weight of 0.9 oz/Yd$^2$; a tenacity of 0.090 g/denier in the machine direction and 0.058 g/denier in the transverse direction; an elongation of 27% in the machine direction and 62% in the transverse direction and a tear strength of 20 g in the machine direction and 27 g in the transverse direction.

EXAMPLE 4

In this example, a nonwoven web was prepared using the same polymer blend used in Example 3 and the melt blowing apparatus was operated at the same conditions as were used in Example 3 except that the gas flow rate was reduced from 85% of maximum to 65% of maximum. The nonwoven mat thus produced comprised micro-denier fibers slightly larger than the fibers in the mat produced in Example 3 but remained uniform in texture, soft and opaque.

EXAMPLE 5

In this example, a nonwoven web was prepared with a blend comprising 75 vol% of the free-radical degraded polymer blend prepared in Example 1 and 25% additional polypropylene identical to that added in Examples 1–4. This blend contained approximately 37.5 wt % elastomer. The melt blowing apparatus was operated in the same manner and at the same conditions used in Examples 1 and 4. The nonwoven web thus produced contained micro-denier fibers, was definitely elastic, uniform in texture, soft and opaque. The fibers were, however, somewhat larger than those produced at the higher gas velocities.

EXAMPLE 6

In this example, a nonwoven web was produced using a blend identical to that used in Example 5 and the melt blowing apparatus was operated at conditions identical to those employed in Example 5 except that the air-flow rate was increased from 65 to 85% max. The nonwoven mat thus produced exhibited definite elasticity, comprised fibers smaller than those contained in the mat of Example 5, was uniform in texture, very soft and opaque.

EXAMPLE 7

In this example, a masterbatch blend comprising 20 wt % of an ethylene-propylene elastomer having a weight average molecular weight of 110,000, 30 wt % of an isobutylene-isoprene elastomer having a weight average molecular weight of 350,000 and 50 wt % of a polypropylene having a melt flow rate of 1.3(230° C.) was prepared using the same Banbury mix cycle that was used in preparing the masterbatch in Example 1. After the blending was completed, the blend was dusted with 0.15 wt % of Lupersol 130 peroxide in a Henschel blender and then free radical degraded by passing the blend through a single screw extruder at a temperature within the range from about 410° F. to about 430° F. A portion of this degraded blend was then combined with additional polypropylene having a melt flow rate of 32(230° C.) (again, higher than that used in the masterbatch) so as to produce a blend containing 25 vol % of the degraded blend and 75 vol% of added polypropylene. The blend contained approximately 12.5 wt % elastomer. The blend was then fed to a melt blowing apparatus identical to that used in the previous example s to produce a nonwoven web. The melt blowing apparatus was operated at the same conditions as were used in Examples 1, 4 and 5 except that the speed of the moving collector was increased from 14 ft/min to 24 ft/min. The nonwoven web produced, unlike the webs produced in the previous examples, contained a macro-denier fiber, was rather open in weave, rather stiff and coarse to the touch having a laced or "bridal veil" appearance but were elastic. The web thus produced had a basic weight of 1.0 oz/yd$^2$; a tenacity of 0.027 g/denier in the machine direction and 0.023 g/denier in the transverse direction; an elongation of 30% in the machine direction and 42% in the transverse direction and a tear strength of 29 g in the machine direction and 24 g in the transverse direction.

EXAMPLE 8

In this example, a nonwoven web was prepared from a blend comprising 50 vol% of the degraded blend prepared in Example 7 and 50 vol % of added polypropylene identical to that added in the previous examples. This blend contained approximately 25 wt % elastomer. The blend was melt blown in the same apparatus used in the previous examples and the apparatus was operated at the same operating conditions employed in Examples 1, 4, 5 and 7 except that the speed of the moving collector was adjusted to 10 ft/min and the collector was positioned 18 inches from the die. The nonwoven web was similar to that obtained in Example 7. After preparation, the web was calendered at a temperature of 200° F. at a pressure of 75 psig and the hot calendering softened the web considerably.

EXAMPLE 9

In this example, a masterbatch blend formulation was prepared comprising 15 wt % of an amorphous low molecular weight ethylene-propylene elastomer having a weight average molecular weight of 110,000, 15 wt % of an ethylene-methylacrylate copolymer containing 20 wt % methylacrylate and having a melt index of 2.4(190° C.) and 70 wt % of an etehylenevinyl acetate copolymer containing about 18 wt % vinyl acetate and having a melt index of 130(190° C.). A portion of this masterbatch blend formulation was then combined with additional ethylene-vinyl acetate copolymer identical to that used in the blend formulation such that the final blend contained 25 vol% masterbatch blend formulation and 75 vol % of added ethylene-vinyl acetate. The final blend contained approximately 3.8% elastomer. This blend was used to prepare a nonwoven web in a melt blowing apparatus identical to that used in the previous examples and operated at the same conditions as were used in Example 8 except that the collector speed was increased from 10 ft/sec to 11 ft/sec. The nonwoven web produced container macro-denier fibers and was particularly unique in that the web was rather open in weave and the web was very elastic. The web thus produced had a basic weight of 3.6 oz/yd$^2$; a tenacity of 0.017 g/denier in the machine direction and 0.012 g/denier in the transverse direction; an elongation of 60% in the machine direction and 80% in the transverse direction and a tear strength of 136 g in the machine direction and 242 g in the transverse direction.

EXAMPLE 10

In this example, a nonwoven web was prepared with a blend comprising 50 vol% of the masterbatch blend formulation prepared in Example 9 and 50 vol% of the same ethylene-vinyl acetate copolymer used in the masterbatch blend formulation. The blend used to prepare the nonwoven web contained approximately 7.5 wt % elastomer. The melt blowing apparatus was operated at conditions identical to those used in Example 9 and the nonwoven web produced had properties very similar to those obtained in Example 9.

EXAMPLE 11

In this example, a nonwoven web was prepared with a polypropylene having a melt flow rate of 32(230° C.) using the same melt blowing apparatus used in the previous examples. In this run, the air flow rate was 80% of maximum and the extruder die head was operated at a temperature of approximately 520° F. The air temperature in the upper air stream at the die head was 527° F. and the temperature of the bottom stream at the die head was 535° F. The resin flow rate through the die head was about 13 lbs/hr during the run. The collector was positioned 12 inches from the die and rotated at 14 ft/min. The web thus produced had a basic weight of 0.9 oz/yd$^2$; a tenacity of 0.194 g/denier in the machine direction and 0.125 g/denier in the transverse direction; an elongation of 99% in the machine direction and 132% in the transverse direction and a tear strength of 27 g in the machine direction and 37 g in the transverse direction. The polypropylene used in this example was the same as that added in Examples 1–6.

EXAMPLE 12

In this example, the procedure summarized in Example 11 was again repeated except that a copolymer of ethylene and vinyl acetate was substituted for the propylene. The copolymer contained 18 wt % vinyl acetate, had a melt index of 130(190° C.) and a density of 0.949 g/cc. The web thus produced had a basic weight of 1.7 oz/yd$^2$; a tenacity of 0.029 g/denier in the machine direction and 0.115 g/denier in the transverse direction; an elongation of 125% in the machine direction and 175% in the transverse direction and a tear strength of 70 g in the machine direction and 115 g in the transverse direction. The copolymer used in this example was the same as that used in Example 9 and 10.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the invention.

Having thus described and illustrated the invention what is claimed is:

1. A method of preparing a nonwoven web comprising (a) forming a polymeric blend comprising (i) from 5 to 75 wt % of an elastomeric copolymer of an isoolefin and a conjugated diolefin and (ii) from 25 to 95 wt % of a thermoplastic olefin polymer resin.

(b) heating the blend to form a melt;

(c) extruding the melt through die openings to form a row of fibers while blowing hot gases on both sides thereof to draw down the fibers and substantially reduce their diameters; and (d) collecting the fibers to form a web.

2. The method of claim 1 wherein the blend comprises from 15 to 50 wt % of the elastomeric copolymer and 50 to 85 wt % of the thermoplastic resin.

3. The method of claim 1 wherein the gas flow onto opposite sides of the fibers is sufficient to reduce the fiber diameter between 0.5 and 5 microns.

4. The method of claim 2 and further comprising the step of thermally or oxidatively degrading a portion of the polymeric blend prior to extruding the blend melt.

5. The method of claim 4 wherein the degraded polymer blend has an intrinsic viscosity of 0.6 to 1.4.

6. The method of claim 1 wherein said thermoplastic olefin polymer resin in said polymeric blend is a copolymer of ethylene and a lower carboxylic acid or an unsaturated ester of a lower carboxylic acid.

7. The method of claim 1 wherein said thermoplastic olefin polymer resin in said polymeric blend is polypropylene.

8. The method of claim 1 wherein said thermoplastic olefin polymer resin is a homopolymer of an a-olefin.

9. The method of claim 1 wherein said thermoplastic olefin polymer resin is a copolymer of ethylene and a lower carboxylic acid or an ester of a lower carboxylic acid.

10. The method of claim 9 wherein additional olefin polymer thermoplastic resin is added to said polymeric blend after said polymeric blend is degraded.

11. The method of claim 1 wherein said elastomeric polymer comprises not more than 30 wt % of said conjugated diolefin.

12. The method of claim 11 wherein said elastomeric polymer contains from about 85 to about 99.5 wt % of said isoolefin and from about 0.5 to about 5 wt % of said conjugated diolefin

13. The method of claim 12 wherein said isoolefin is isobutylene and said conjugated diolefin is isoprene.

14. The method of claim 6 wherein said thermoplastic olefin polymer resin is a copolymer of ethylene and vinyl acetate.

* * * * *